US007524076B2

(12) United States Patent
Kukuk

(10) Patent No.: US 7,524,076 B2
(45) **Date of Patent: *Apr. 28, 2009**

(54) MULTI-FUNCTIONAL LAW ENFORCEMENT TOOL

(76) Inventor: Craig Kukuk, 13111 W. Telemark Ct., Boise, ID (US) 83713

( * ) Notice: Subject to any disclaimer, the term of this patent is extended or adjusted under 35 U.S.C. 154(b) by 267 days.

This patent is subject to a terminal disclaimer.

(21) Appl. No.: 11/515,322

(22) Filed: Sep. 1, 2006

(65) Prior Publication Data

US 2007/0086190 A1 Apr. 19, 2007

Related U.S. Application Data

(63) Continuation-in-part of application No. 10/775,316, filed on Feb. 10, 2004, now Pat. No. 7,152,990, which is a continuation-in-part of application No. 10/139,582, filed on May 3, 2002, now Pat. No. 7,004,597, which is a continuation-in-part of application No. 09/699,846, filed on Oct. 29, 2000, now Pat. No. 6,499,855.

(60) Provisional application No. 60/162,251, filed on Oct. 29, 1999.

(51) Int. Cl.
*F41G 1/34* (2006.01)

(52) U.S. Cl. ..... 362/112; 362/96; 362/109; 362/253

(58) Field of Classification Search ..... 362/96, 362/109, 112, 114, 157, 253
See application file for complete search history.

(56) References Cited

U.S. PATENT DOCUMENTS 2,626,516 A * 1/1953 Green ..... 66/201
2,629,516 A 2/1953 Badham ..... 222/79
3,737,649 A 6/1973 Nelson et al. ..... 362/102
3,776,429 A 12/1973 DeLucia ..... 222/162
4,186,851 A 2/1980 Cantor ..... 222/113
4,223,804 A 9/1980 Morris et al. ..... 222/3
4,842,277 A 6/1989 LaCroix ..... 273/84
5,086,377 A 2/1992 Roberts ..... 362/102
5,103,366 A * 4/1992 Battochi ..... 361/232
5,287,255 A 2/1994 Strodtman ..... 362/102

(Continued)

*Primary Examiner*—Sandra O'Shea
*Assistant Examiner*—James W Cranson
(74) *Attorney, Agent, or Firm*—Pedersen & Co., PLLC; Ken J. Pedersen; Barbara S. Pedersen

(57) ABSTRACT

The invention is a multifunctional law enforcement tool, which includes several of the tools needed by law enforcement and security personnel. In one embodiment, the multifunctional tool comprises a flashlight, deterrent spray dispenser and removable cartridge housing. The cartridge housing is an open bay on the tool, and is adapted to receive cartridges which allow the user to fire non-lethal rounds such as bean bags, rubber balls, O.C. powder, multiple probe neuromuscular disruption rounds, and many other projectiles. Inserted cartridges also fire tactical rounds such as colored smoke, breach rounds, and concussion rounds. In addition, the tool may optionally include LED light, stun gun, stun projectile, glass breaker, I.D. card holder, pistol mount, laser sight, and audio microphone or audio/visual camera. Additionally, a standard defense, ballistic defense and/or electrified "stun" shield may be attached to the tool. Additionally, a handle canister with dual bladders creating a deterrent spray stun mechanism may be provided. Additionally, other optional equipment, for example, a walkie talkie, telephone, safety strap, video display screen and Global Positioning System may also be added to the tool.

21 Claims, 18 Drawing Sheets

U.S. PATENT DOCUMENTS

| | | | | |
|---|---|---|---|---|
| 5,405,134 | A | 4/1995 | Wolfram | 463/47.4 |
| 5,446,985 | A | 9/1995 | Chen | 42/1.08 |
| 5,683,168 | A | 11/1997 | Teig et al. | 362/96 |
| 5,795,054 | A | 8/1998 | Booty, Jr. | 362/96 |
| D401,374 | S | 11/1998 | Lum | D26/38 |
| 6,139,165 | A | 10/2000 | Crowe | 362/102 |
| 6,199,997 | B1 | 3/2001 | Outsen et al. | 362/109 |
| 6,237,461 | B1 | 5/2001 | Poole | 89/1.11 |
| 6,386,726 | B1 | 5/2002 | Macierowski et al. | 362/102 |
| 6,394,622 | B1 | 5/2002 | Macek | 362/96 |
| 6,499,855 | B1 | 12/2002 | Kukuk | 362/102 |
| 6,615,622 | B2 | 9/2003 | MacAleese et al. | 70/16 |
| 6,666,566 | B1 | 12/2003 | Uke | 362/109 |
| 7,047,686 | B2 * | 5/2006 | Zimmermann | 42/75.1 |
| 7,100,602 | B2 * | 9/2006 | Cole et al. | 128/200.14 |
| 7,152,990 | B2 * | 12/2006 | Kukuk | 362/112 |
| 7,302,880 | B1 * | 12/2007 | Elasic | 89/36.07 |
| 2006/0086032 | A1 * | 4/2006 | Valencic et al. | 42/70.01 |

* cited by examiner

341

339

13B

13A

14B

14A

MULTI-FUNCTIONAL LAW ENFORCEMENT TOOL

DESCRIPTION

This is a continuation-in-part of patent application Ser. No. 10/775,316, filed Feb. 10, 2004, which is a continuation-in-part of patent application Ser. No. 10/139,582, filed May 3, 2002, issued Feb. 28, 2006 as U.S. Pat. No. 7,004,597, which is a continuation-in-part of patent application Ser. No. 09/699,846, filed Oct. 29, 2000, issued on Dec. 31, 2002 as U.S. Pat. No. 6,499,855, which claimed priority of Provisional Application No. 60/162,251, filed Oct. 29, 1999.

BACKGROUND OF THE INVENTION

1. Field of the Invention

This invention relates generally to law enforcement and security equipment. More specifically, this invention relates to different combinations of a flashlight, LED light, deterrent spray, deterrent spray stun mechanism, stun gun, pistol mount, audio recorder, video recorder, laser sight, glass breaker, I.D. holder and numerous non lethal and tactical cartridge capabilities, as well as numerous electrified, ballistic and standard defense shields, and an orthogonal handle.

2. Related Art

U.S. Pat. No. 2,629,516 (Badham) discloses a detachable handle spray canister to a flashlight.

U.S. Pat. No. 4,186,851 (Cantor) discloses a combination flashlight and deterrent spray.

U.S. Pat. No. 4,842,277 (LaCroix) discloses a combination flashlight and stun gun.

U.S. Pat. No. 6,237,461 (Poole) discloses a combination flashlight, deterrent spray, stun gun mechanism and laser sight.

U.S. Pat. No. 6,386,726 (Macierowski) discloses a combination flashlight, baton, pepper spray.

U.S. Pat. No. 6,394,622 (Macek) discloses a combination flashlight, deterrent spray and stun gun.

U.S. Pat. No. 6,666,566 (Uke) discloses a glass breaking mechanism and a flashlight combination.

Still, there is a need for a compact but effective multifunctional law enforcement tool with a flashlight, LED light, deterrent spray, deterrent spray stun mechanism, stun gun, pistol mount, audio/video camera, laser sight, glass breaker, I.D. holder and numerous non lethal and tactical cartridge capabilities, as well as numerous electrified, ballistic and standard defense shields, and an orthogonal handle. This invention addresses the needs of law enforcement and security personnel for this type of equipment.

SUMMARY OF INVENTION

The invention is a multifunctional law enforcement tool that may serve an officer's need to have various equipment features and options quickly at hand, while keeping the officer's gun hand free. In one embodiment, the invention comprises a multifunctional tool with capability for at least several of a flashlight, LED light, deterrent spray, deterrent spray stun mechanism, stun gun, pistol mount, audio/video camera, laser sight, glass breaker, I.D. holder and numerous removable non lethal and tactical cartridge capabilities adapted to be received by the tool, and an orthogonal handle. In a second embodiment, a standard defense shield may be attached to the first embodiment. In a third embodiment, a ballistic defense shield may be attached to the first embodiment. In a fourth embodiment, an electrified defense shield may be attached to the first embodiment. In a fifth embodiment, a handle canister with dual bladders is provided in the orthogonal handle, creating a deterrent spray stun mechanism. In a sixth embodiment a walkie talkie, Global Positioning System, telephone, video display and safety strap are included with the tool, giving the user greater communication ability and added safety.

The invented multifunctional law enforcement tool allows several important devices to be easily at hand for law enforcement and security personnel in a single unit. By having the capability for all the tools to be combined into one unit, this leaves the user's gun hand always free. Also, the invented multifunctional tool places both offensive and defensive tools together in the user's hands along with the flashlight. Having the capability for many of the commonly used tools to be ready immediately greatly increases an officer's options when dealing with the uncertainties of a suspect's behavior. The officer may approach a suspect with the invented multifunctional tool in one hand, and, with his other hand ready at his gun, may respond to a suspect's behavior appropriately, quickly choosing from a plurality of options. The user need not whisk out a separate stun gun, pepper spray can or any other tool that he may need. These actions may be threatening and confrontational and may escalate the situation. Instead, he can hold and use the multifunctional law enforcement tool as a flashlight, which is a non-threatening action, while having the other defensive and offensive tools ready for use. Thus, the invented combinations allow the user to be more in control of the situation and ready for any turn of events.

Another object of the invented multifunctional law enforcement tool is to eliminate the need of several different objects (spray, stun gun, flashlight, glass breaker, etc.) to be clipped separately onto an officer's belt. This eliminates the "clutter" of the separate objects, and reduces total weight because the invention may weigh significantly less, by about two (2) or three (3) pounds, than the total of the separate objects. Also, for example, for a female officer with a small waist, it is difficult to find the space to position the separate objects around her belt.

Another possible use of the invented multifunctional tool is with airline security. These non-lethal options will help detain or incapacitate confrontational passengers or even terrorists where more lethal alternatives would be less appropriate.

DESCRIPTION OF THE PREFERRED EMBODIMENTS

Referring to the Figures, these depict several, but not all, of the embodiments of the present invention, which is a multi-functional law enforcement tool. In the following description of the preferred embodiment, the term "distal" refers to the end containing the flash light, LED light, stun gun and deterrent spray ports, away from the hand of a user. Because the typical use of the invention is with the flashlight pointing "forward" from the user, the flashlight end is also in the "forward" direction. The term "proximal" refers to the end closer to the hand of a user. This proximal end contains the I.D. holder, gun mount, laser sight and spray actuator button and switches, and will be referred to as the "rearward" direction. The glass optional breaker is located at the "bottom" of the handle canister, and will be referred to as the "bottom" direction.

Figure 1:
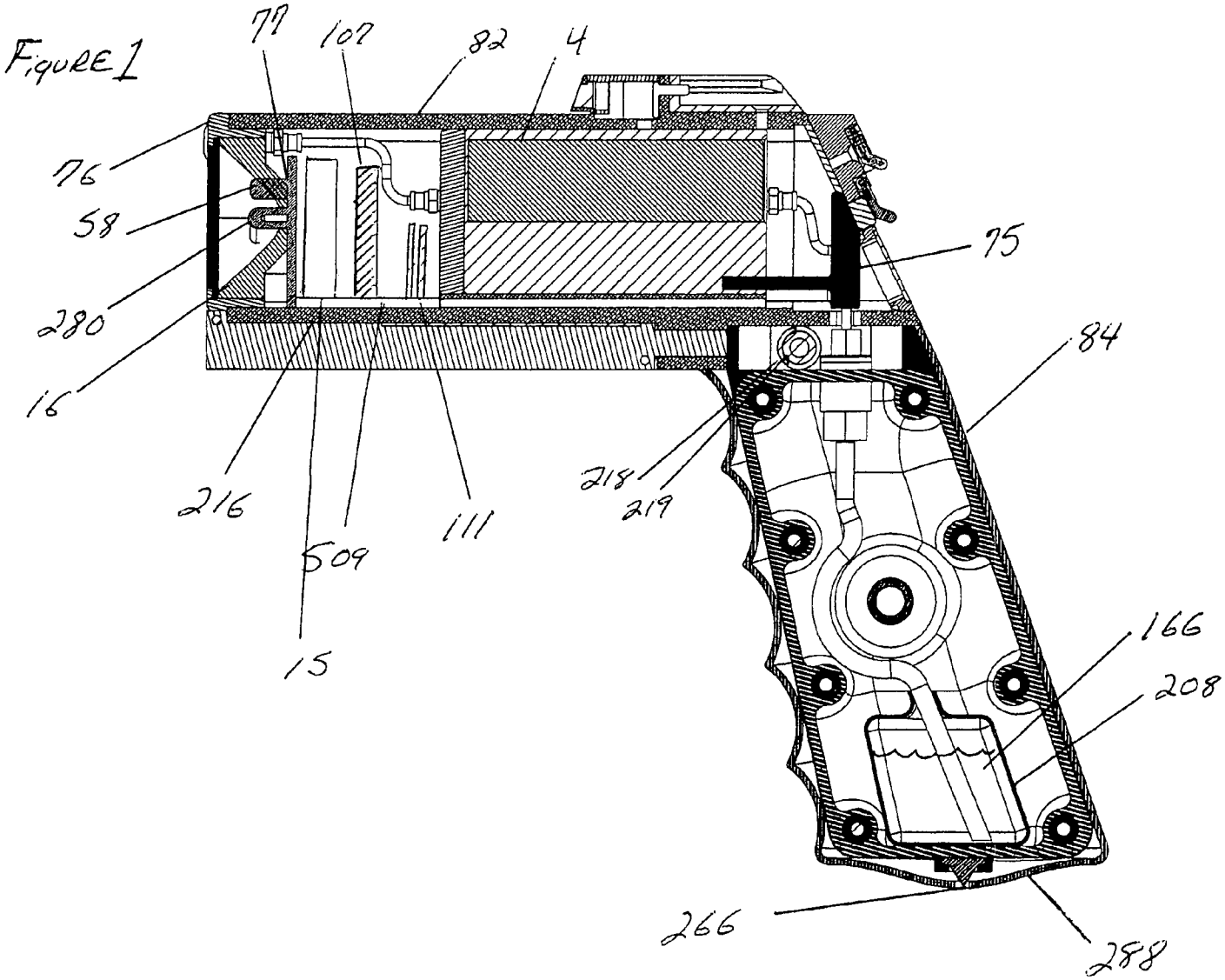
FIG. 1 depicts a side cross-sectional view of one embodiment of the Invention.
Figure 5:
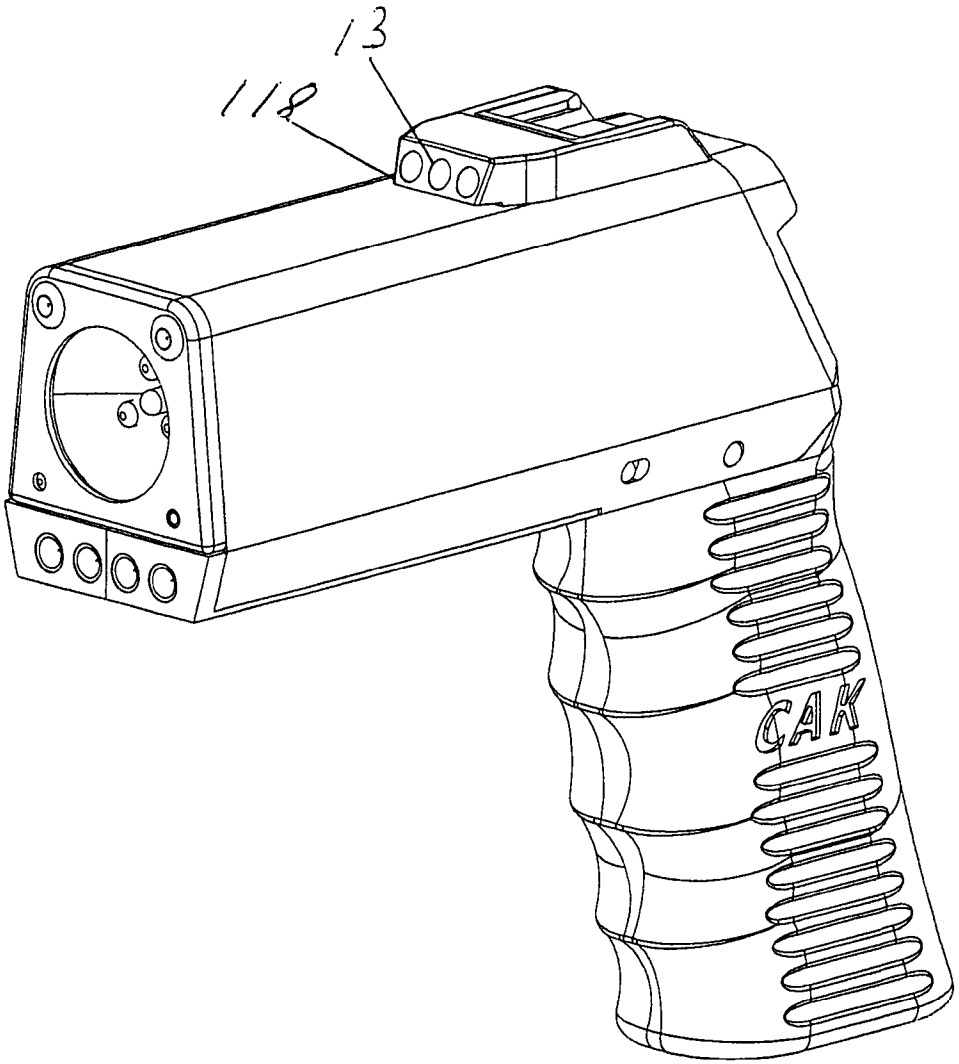
FIG. 5 depicts a front, perspective view of an optional identification card holder and laser sight for the embodiment depicted in FIG. 1.

FIG. 1 depicts a first embodiment of the invented multi-functional law enforcement tool, which comprises a handle unit. According to these Figures, FIG. 1 comprises an Exterior Shell 82 and a Handle Canister 84. The interchangeably connectable orthogonal Handle Canister 84 preferably extends integrally from Exterior Shell 82, wherein interchangeably connected Handle Canister 84 houses Deterrent Spray Bladder 208 of FIG. 1, Deterrent Spray Liquid 166 of FIG. 1, Spray Stems 210 and 211 of FIG. 5, and Air Intake Valve 212 of FIG. 6. Handle Canister 84 is connected and held in place by Retractable Pins 213 and 214 of FIG. 5 and Compressible Spring 215 of FIG. 5. The Retractable Pins 213 and 214 connect Handle Canister 84 to Cartridge Housing 216 of FIG. 1 by expanding into Cartridge Housing Holes 218 and 219 of FIG. 1, locking it into place. The interchangeably connectable orthogonal Handle of FIG. 5 maintains a Rubber Grip cover 288 which not only acts as a grip for the user, but includes a compressible feature when used in concert with Glass Breaking Mechanism 266 of FIG. 1. When Rubber Cover of 288 of FIG. 5 is struck against glass, it will compress, leaving Glass Breaking Mechanism 266 of FIG. 1 exposed to strike against said glass. Once broken, decreased pressure against the Rubber Grip Cover 288 will allow it to regain its normal shape and to cover Glass Breaking Mechanism 266 of FIG. 1.

Figure 9:
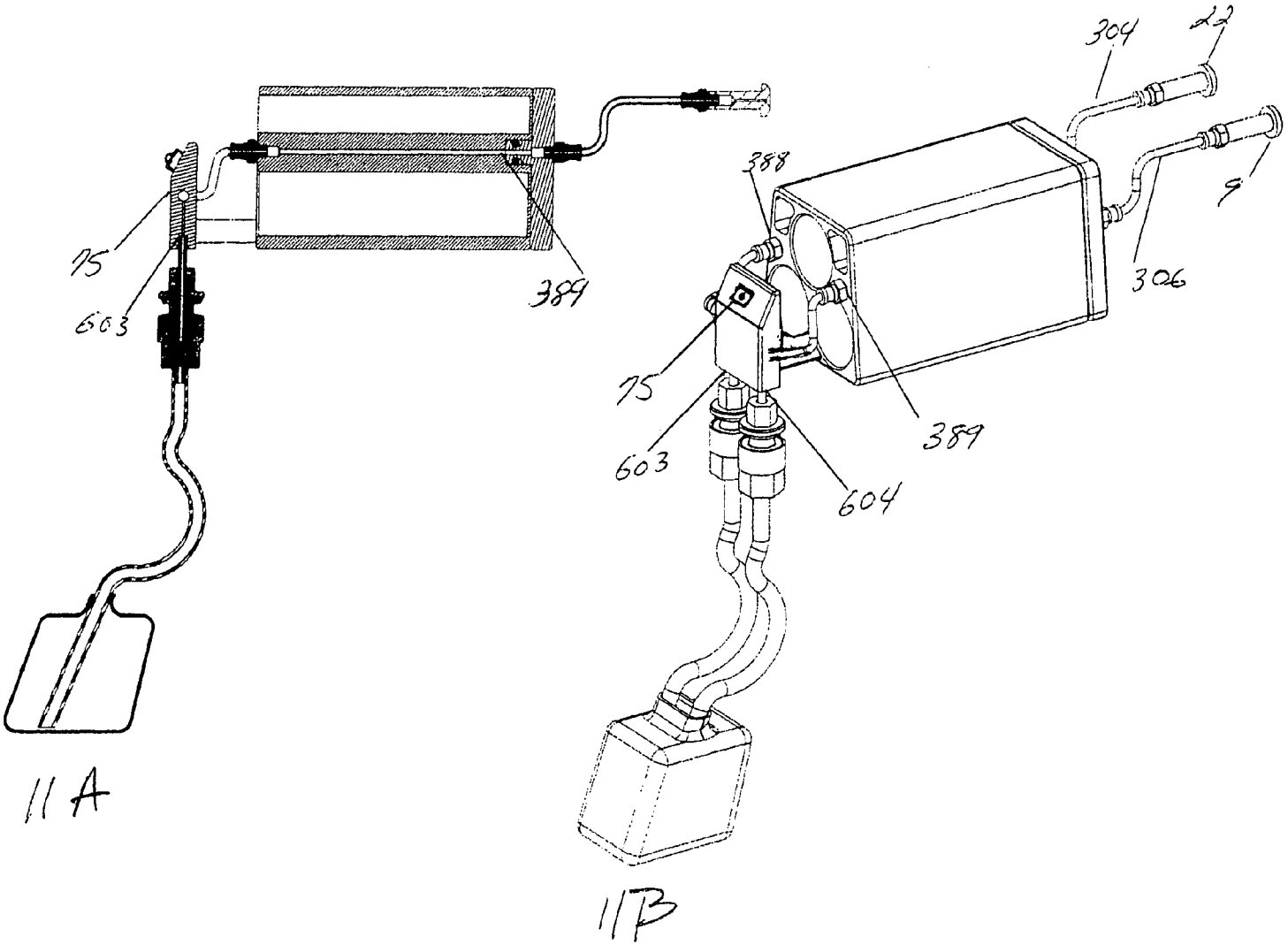
FIGS. 9A and B depict a side cross-sectional and a rear perspective view, respectively, of optional deterrent spray tubes, stun/spray actuator/battery housing, spray exit ports, and deterrent spray bladders of one embodiment of the Invention.

The location of Handle Canister 84 on Exterior Shell 82 is determined from balance, weight and center of gravity considerations. Preferably, the Handle Canister 84 and Exterior Shell 82 will be equal in length on FIG. 1. The Exterior Shell 82 of FIG. 1 possesses 4 internal housings. Stun/Spray Actuator/Battery Housing 75 houses Batter Pack 4 of FIG. 20 in its most rearward section. The Electronics Housing 509 of FIG. 1 houses Electrical Transformer 15, Circuit Boards 111, Microprocessor 107, Bulb Holder 77, Flashlight Bulb 280, LED Lights 58, and is located between Stun/Spray Actuator/Battery Housing 75 of FIG. 1 and the second most forward housing, which is the Parabolic Reflector 16 of FIG. 1. The most forward housing is Lens Cover Unit 76 of FIG. 1. Lens Cover Unit 76 of FIG. 2 houses Video Camera 199, Microphone 198, Flashlight Lens 10, Stun Gun Probes/Battery Recharge Contacts 8 and 21, and Deterrent Spray Exit Ports 22 and 9. In FIG. 9, Spray Tubes 304 and 306 connect to Spray Exit Ports 22 and 9 at the most forward end and to Stun/Spray Actuator/Battery Housing 75 at its most rearward end. Stun/Spray Actuator/Battery Housing 75 of FIG. 9 has Spray Stem Receptor Holes 603 and 604, wherein Handle Canister 84 of FIG. 5's Spray Stems 210 and 211 couple together when the handle is attached to the cartridge housing. Stun/Spray Actuator/Battery Housing 75 contains Spray Cylinder Holes 388 and 389 of FIG. 9, which act as a conduit for spray between Spray Stems 210 and 211 of FIG. 5 and Spray Tubes 304 and 306 of FIG. 9.

Figure 2:
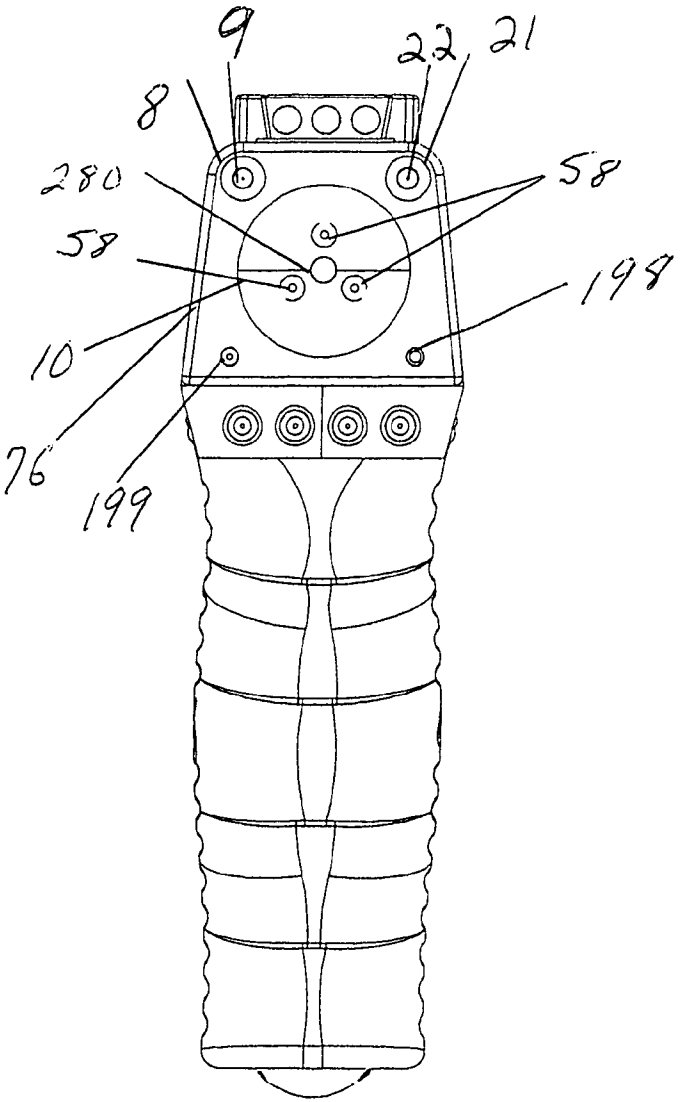
FIG. 2 depicts a front view of the embodiment depicted in FIG. 1.

In FIG. 2, Deterrent Spray Exit Ports 22 and 9 are designed to propel deterrent spray in two (2) high pressure straight parallel streams into the eyes, mouth or facial region of a suspect or suspects. Stun/Spray Actuator/Battery Housing 75 of FIG. 1 must be pushed by user in a forward manner to initiate deterrent spray forward through Spray Cylinder Holes 388 and 389 then through Deterrent Spray Tubes 304 and 306 of FIG. 9.

Figure 17:
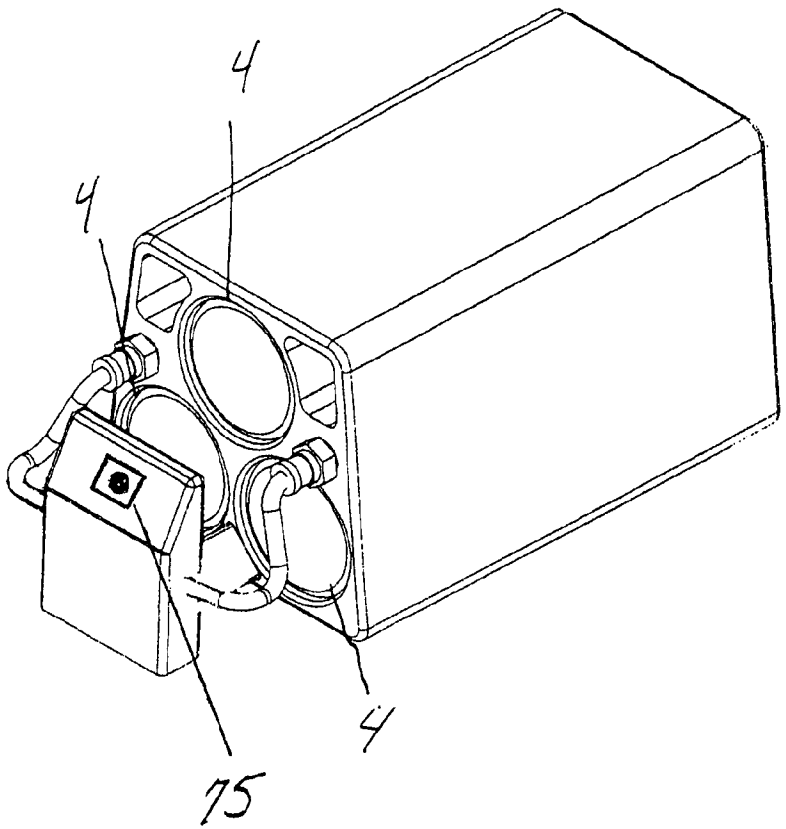
FIG. 17 depicts a rear, perspective view of the stun/spray actuator/battery housing of one embodiment of the Invention.

Stun Gun Probes/Battery Recharge Contacts 8 and 21 of FIG. 2 are metal contacts that surround Deterrent Spray Exit Ports 22 and 9. The user may activate the stun gun feature of pushing the Stun Gun Button 42 of FIG. 8 down. Instantly a high voltage arc will be visible between Stun Gun Probes/Battery Recharge Contacts 8 and 21 of FIG. 2. The user may disable an attacker by simply touching the attacker with as much as, but not limited to, 400,000 volts, causing a neuromuscular disruption. The user may also activate the stun feature by pushing the Stun/Spray Actuator/Battery Housing 75 of FIG. 17.

Figures 8A, 8B, 8C:
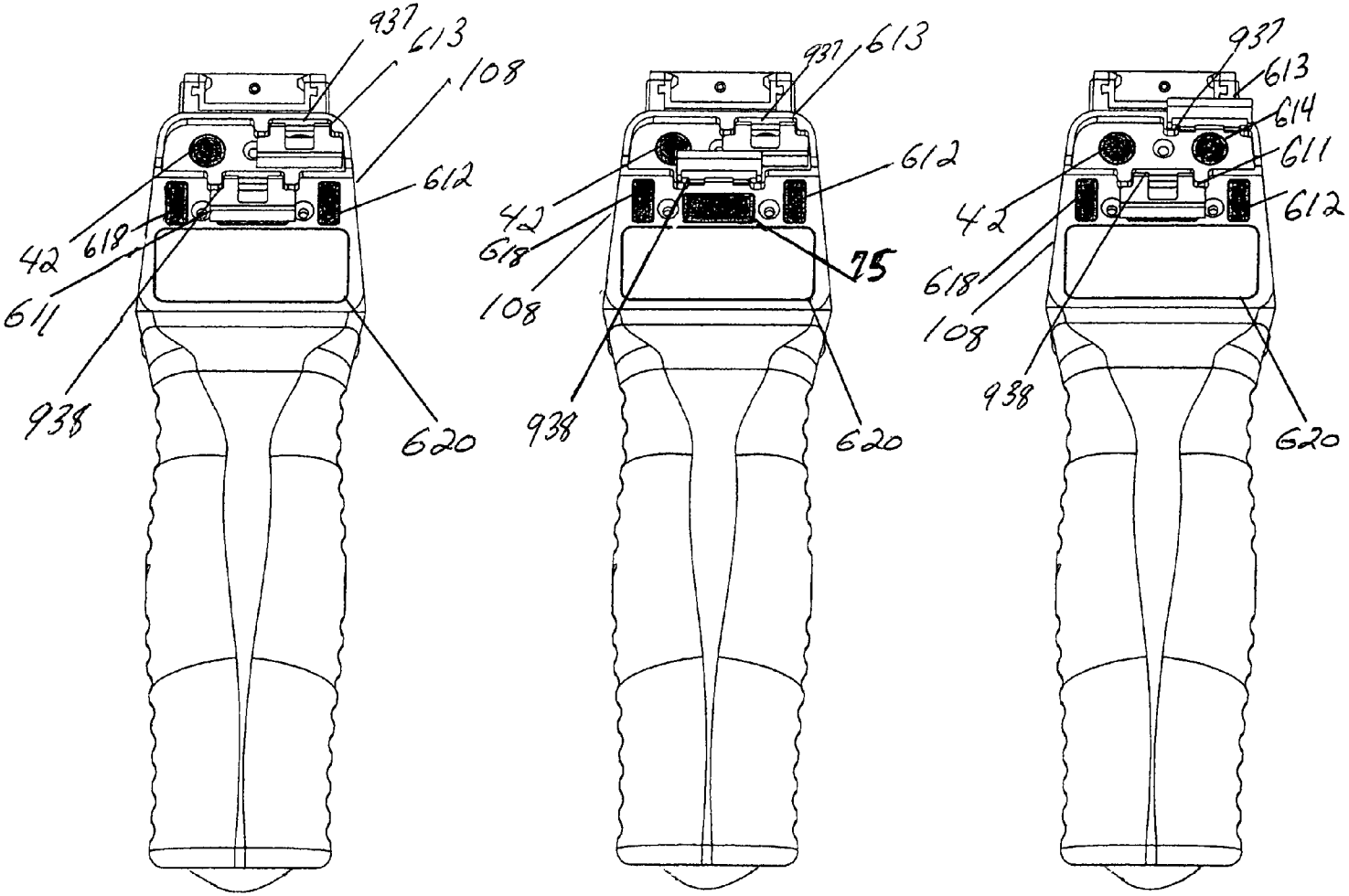
FIGS. 8A-C depict rear views of FIG. 1's switch panel in various stages of activation.

In FIG. 8, Switch Panel 108 houses Spray Actuator Cover 611, Menu Button 612, Stun Gun Button 42, Cartridge Button Cover 613, Cartridge Button 614, Light Button 618, and Liquid Crystal Display 620. If Spray Actuator Cover 611 or Cartridge Button Cover 613 of FIG. 8 are lifted in an upward manner by the user, Laser Sight 13 of FIG. 5 automatically will turn on, lining up the target. To close said covers, Return Springs 937 and 938 of FIG. 8 returns the covers to their original closed position if the user removes his or her thumb from cartridge or spray covers. If the user intends to fire deterrent spray, he must lift the Spray Actuator Cover 611, then push the Stun/Spray Actuator/Battery Housing 75 of FIG. 8 forward. To fire a cartridge, the user must lift Cartridge Button Cover 613, then press the Cartridge Button 614 of FIG. 8. By pushing Stun/Spray Actuator/Battery Housing 75 or the Cartridge Button 614 the stun feature is automatically activated. This gives the user the ability to stun a suspect who has fought through the effects of a spray or cartridge and then tries to attack the user.

Figure 6:
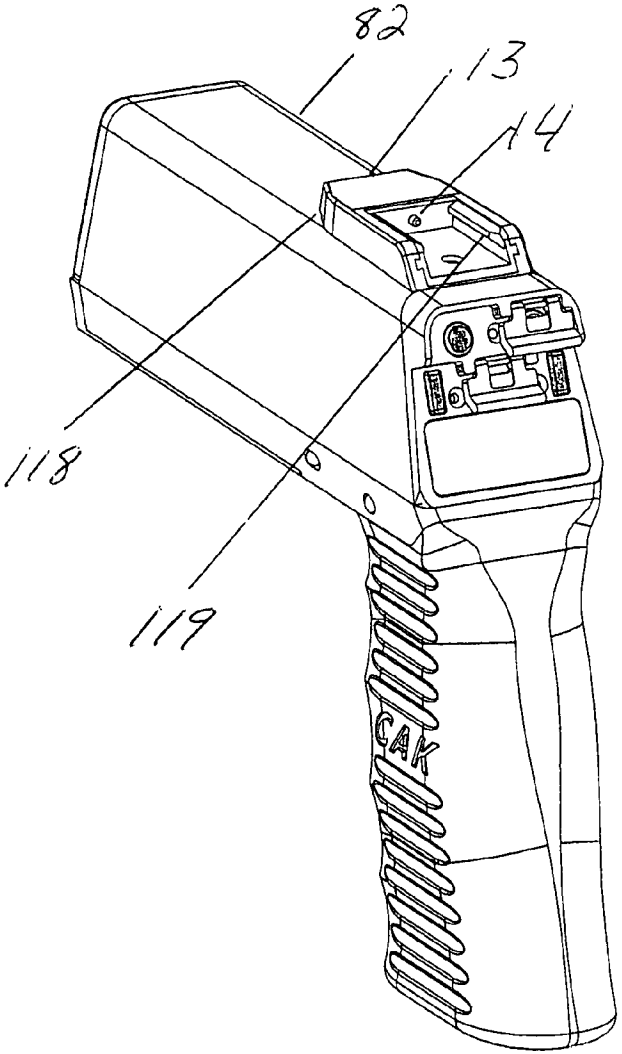
FIG. 6 depicts a rear, perspective view of an optional pistol mount and laser sight button for the embodiment depicted in FIG. 1.
Figure 7:
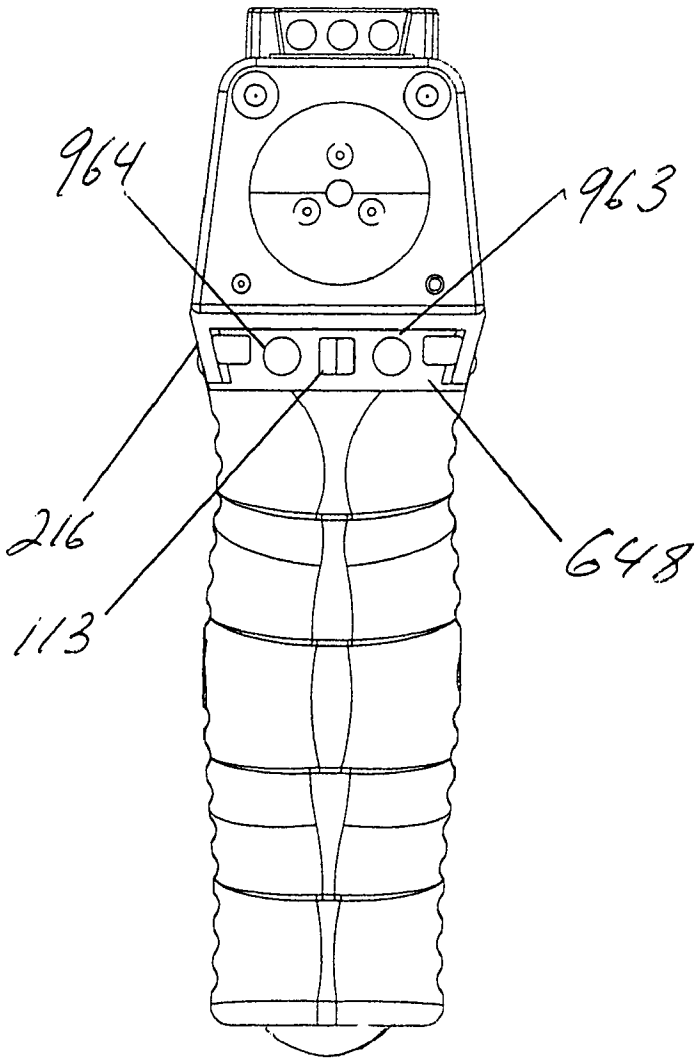
FIG. 7 depicts a front view of the embodiment depicted in FIG. 1 with the cartridge housing, but without a cartridge.
Figures 11A, 11B, 11C, 11D, 11E:
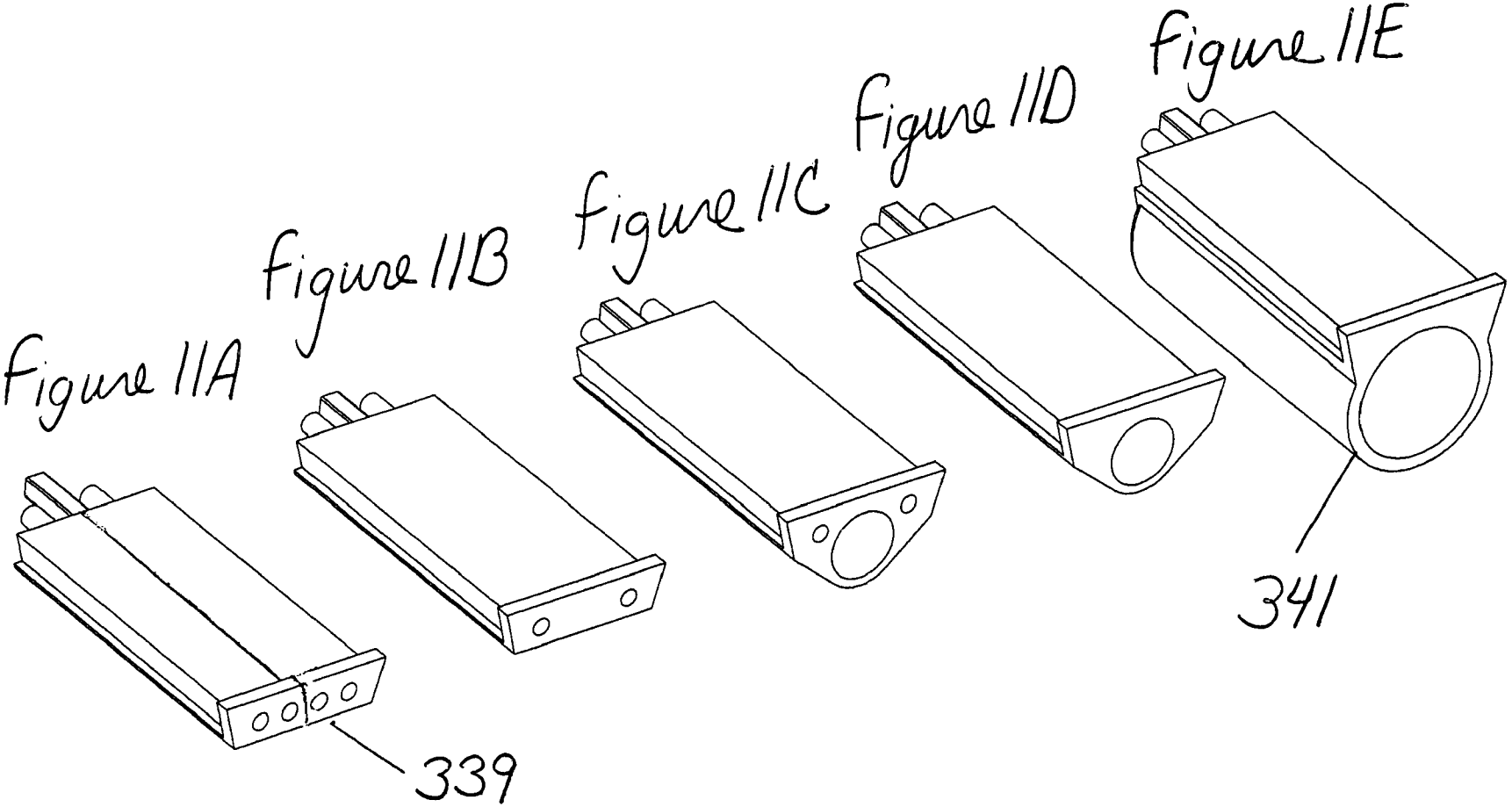
FIGS. 11A-E depict front, perspective views of different cartridges for the cartridge housing depicted in FIG. 1.
Figure 12:
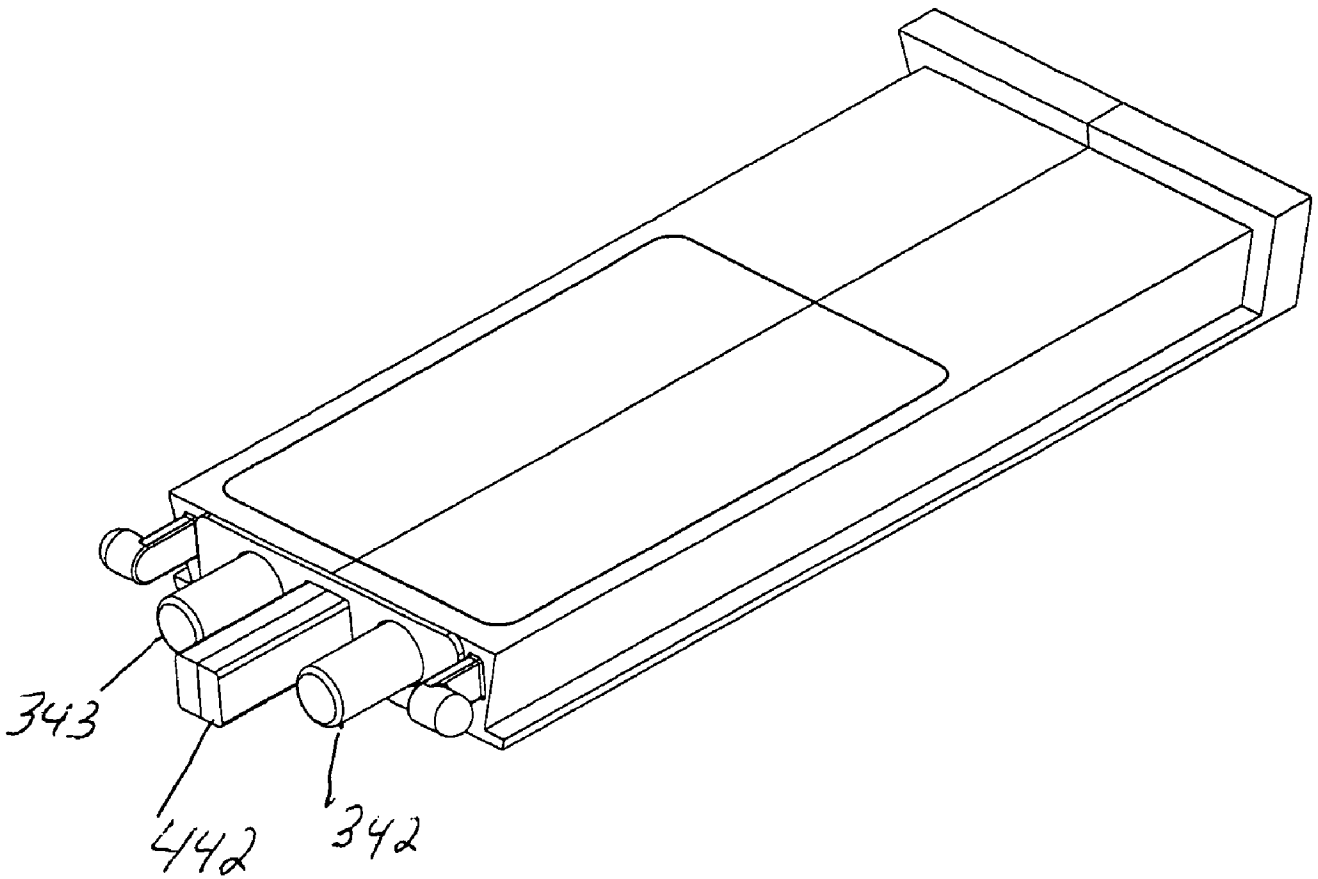
FIG. 12 depicts a rear, perspective view of the cartridge shells and electronics connection for the embodiment depicted in FIG. 1.

Non lethal and tactical disposable cartridges are housed in Cartridge Housing 216 of FIG. 7. The user simply slides in an unused cartridge rearward until the Cartridge Contact 442 of FIG. 12 couples together with cartridge housing Electrical Contact 113 of FIG. 7. The cartridges which carry an explosive, such as gun powder, and the electrical connection couple together to create a controlled explosion. This propels a projectile or projectiles forward once the user lifts the Cartridge Button Cover 613 of FIG. 8, then presses the Cartridge Button 614 of FIG. 8. Laser Sight 13 of FIG. 6 lines up with the target as soon as the cartridge button cover is lifted. The Cartridge Housing is an open bay on the Bottom 648 of FIG. 7. The Open Bay gives the Multifunctional Law Enforcement Tool the ability to shoot various sizes and styles of projectiles in many different size cartridges (FIG. 11). Cartridge projectiles may vary in size from as small as, but not limited to, 5 millimeter non-lethal Neuromuscular Disruptive Dart Cartridge 339 of FIG. 11 to as large as, but not limited to, a 40 millimeter tactical Smoke Round Cartridge 341 of FIG. 11. The rearward section of the cartridge houses, cartridge shells 342 and 343 of FIG. 12. Inside these shells is where the gunpowder is housed and the controlled explosion takes place. When the cartridge is installed, Cartridge Shells 342 and 343 of FIG. 12, mate with Chambers 963 and 964 of the Cartridge Housing 216 of FIG. 7. Cartridge Housing Electrical Contact 113 of FIG. 7 and Cartridge Contact 442 of FIG. 12 mate at the same time.

Figure 3:
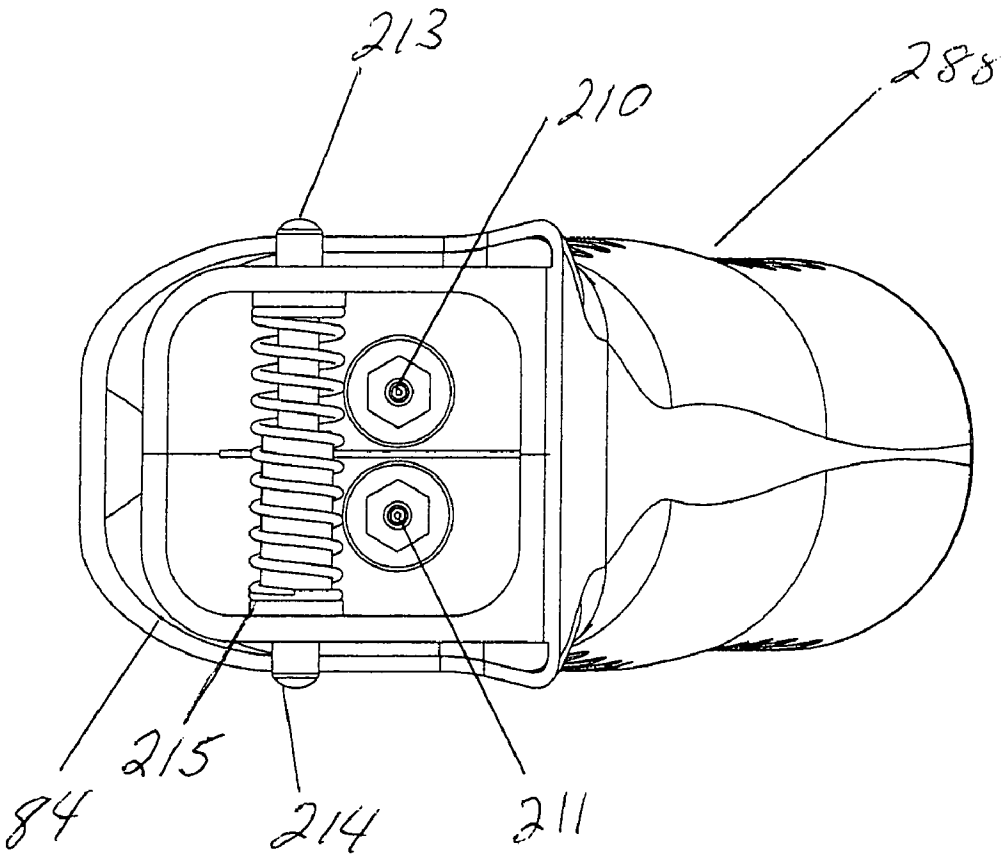
FIG. 3 depicts a top, partial view of the interior of the handle canister for one embodiment of the Invention.
Figure 4:
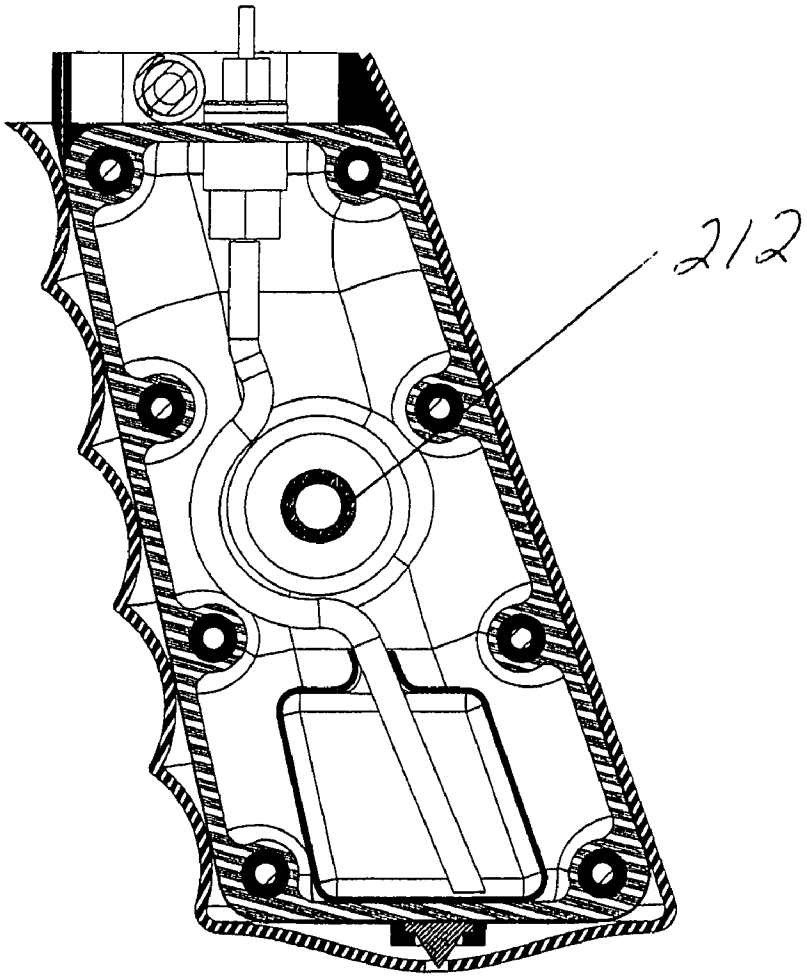
FIG. 4 depicts a side, cross-sectional view of the handle canister depicted in FIG. 5.

In FIG. 8, Switch Panel 108 houses Light Button 618. Light Button 618, together with Parabolic Reflector 16 and Flashlight Bulb 280 of FIG. 1, create a flashlight when the user manually pushes Light Button 618 of FIG. 8 in a downward manner. This creates a flashlight beam up to, but not limited to, 20,000 candlepower. If the Light Button is pushed a second time, the Low Intensity LED Lights 58 of FIG. 2 will turn "on" and simultaneously turn off the Flashlight Bulb 280 of FIG. 3. The LED Lights' function is used to save energy, but may create as much as, but not limited to, 8 lumens. If the Light Button 618 of FIG. 8 is turned "on," the Video Camera 199 and the Microphone 198 of FIG. 2 will be simultaneously turned on. This will allow the user to illuminate the subject and simultaneously have audio and video of their actions. The audio and video will be sent by the multifunctional law enforcement tool to the officer's car as far as, but not limited to, 1,000 feet away, where the images may be captured.

Figure 10:
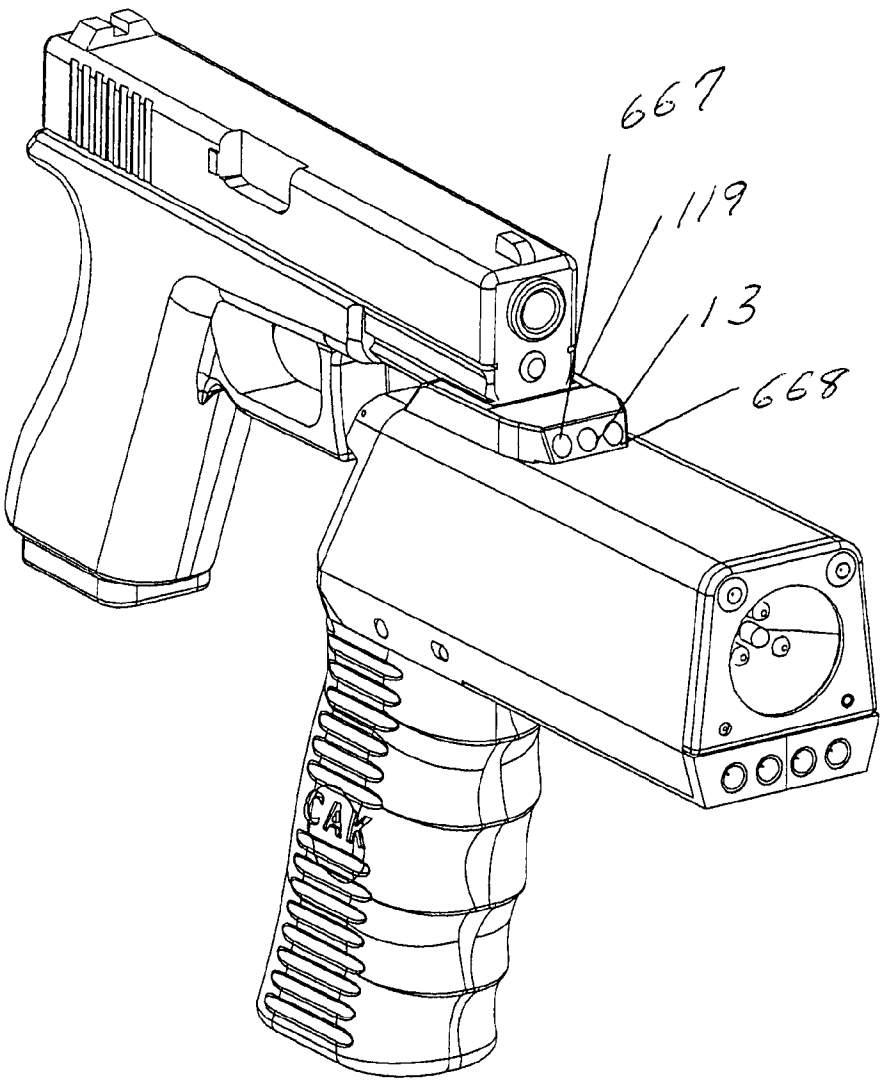
FIG. 10 depicts a front, perspective view of a pistol engaged within an optional pistol mount of the embodiment depicted in FIG. 1.

FIG. 6 depicts Identification Card Holder 118, Gun Mount 119 and Laser Sight 13. I.D. LED Lights 667 and 668 of FIG. 10 and Laser Sight Button 14 of FIG. 6 are at the rearward section of Exterior Shell 82. The Identification Card Holder 118 of FIG. 5 is a slot that, through frictional engagement, holds an I.D. securely in place, allowing the officer to keep his gun hand free. I.D. Holder LED Lights 667 and 668 of FIG. 10 can illuminate an identification card by simply pushing and holding down Light Button 618 of FIG. 8. Gun Mount 119 of FIG. 10, Laser Sight Button 14 of FIG. 6, and Laser Sight 13 of FIG. 10 depict how an officer can couple together the Gun Mount 119 of FIG. 6's rails that may correspond with the grooves on the bottom of many of today's pistols. When the officer slides his pistol into the Gun Mount 119 of FIG. 6, it is pushed to its furthest point forward, at which point the front of the pistol will engage Laser Sight Button 14 of FIG. 6, turning on Laser Sight 13 of FIG. 6. This action enables an officer to steadily aim his pistol while capturing the subject with the laser sight. The Multifunctional Law Enforcement Tool can also illuminate and video the subject at the same time, giving authorities a factual interpretation of events.

In FIG. 8, Menu Button 612 may be manually activated by the user to attain a desired function of the multifunctional law enforcement tool. By repeatedly pushing the Menu Button 612, the user simultaneously changes potential functions that are visible on the Liquid Crystal Display 620 of FIG. 8. The user will then firmly hold down the Menu Button, "locking in" the desired feature.

Figure 13:
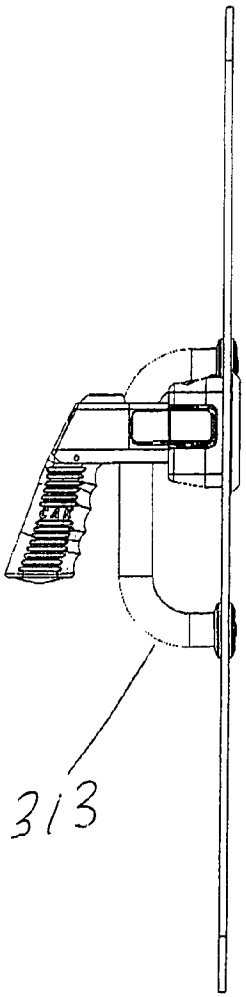
FIGS. 13A and B depict a front view and a right, side view, respectively, of the embodiment depicted in FIG. 1 connected to a standard defense shield.
Figure 13:
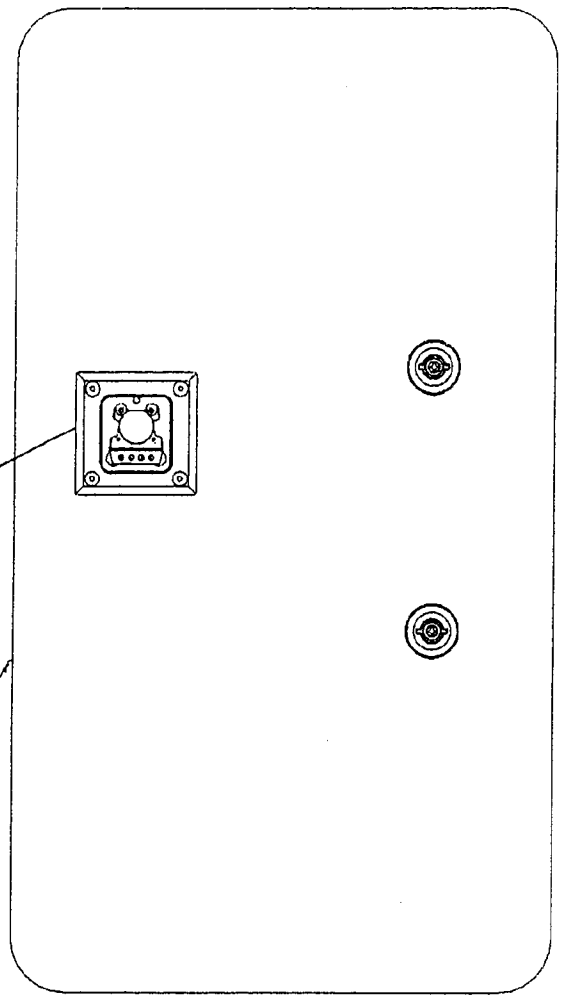

In a second embodiment of the Multifunctional Law Enforcement Tool, FIG. 13 depicts a Defense Shield 885, a Defense Shield Housing 837, a Stationary Handle 313, and the Multifunctional Tool of FIG. 1 coupled together to create an offensive and defensive shield. The user simply slides the Multifunctional Law Enforcement Tool of FIG. 1 forward into Defense Shield Housing 837 of FIG. 13 until Shield Lock 809 of FIG. 14 securely locks the Multifunctional Tool, creating a handle. The user holds this handle and Stationary Handle 313 of FIG. 13, and is now prepared to use all the offensive tools of the Multifunctional Tool, such as firing projectiles or deterrent spray in an offensive manner, as well as using the Defense Shield 885 of FIG. 13 to defend against thrown kicks, punches or debris in a defensive manner. The user still maintains the ability to use the flashlight, LED light, laser sight and audio/video camera, but loses the ability to use the gun mount and stun gun features.

Figure 15:
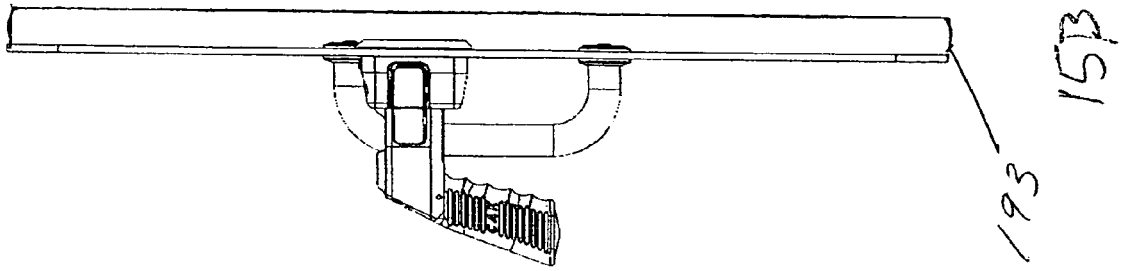
FIGS. 15A and D depict a front view and a right, side view, respectively, of the FIG. 1 embodiment connected to a ballistic defense shield.
Figure 15:
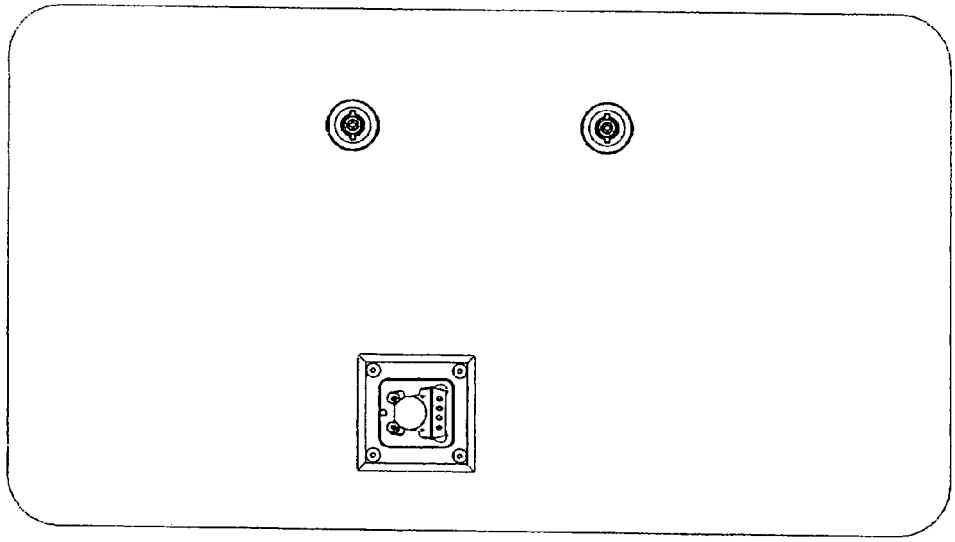

In a third embodiment the Multifunctional Law Enforcement Tool of FIG. 1 is coupled together with the Standard Defense Shield of the third embodiment wherein the Standard Defense Shield is covered by a Ballistic Material 193 of FIG. 15 to stop a bullet or lethal projectile. The rest of the Multifunctional Law Enforcement Tool of FIG. 1 and the Standard Defense Shield of FIG. 13 of the Third Embodiment remains unchanged.

Figure 14:
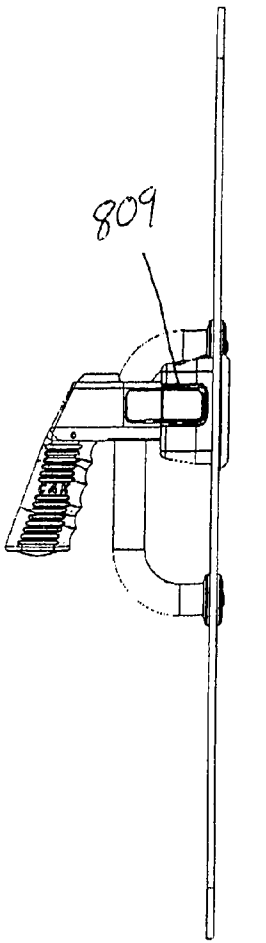
FIGS. 14A and B depict a front view and a right, side view, respectively, of the FIG. 1 embodiment connected to an electrified defense shield.
Figure 14:
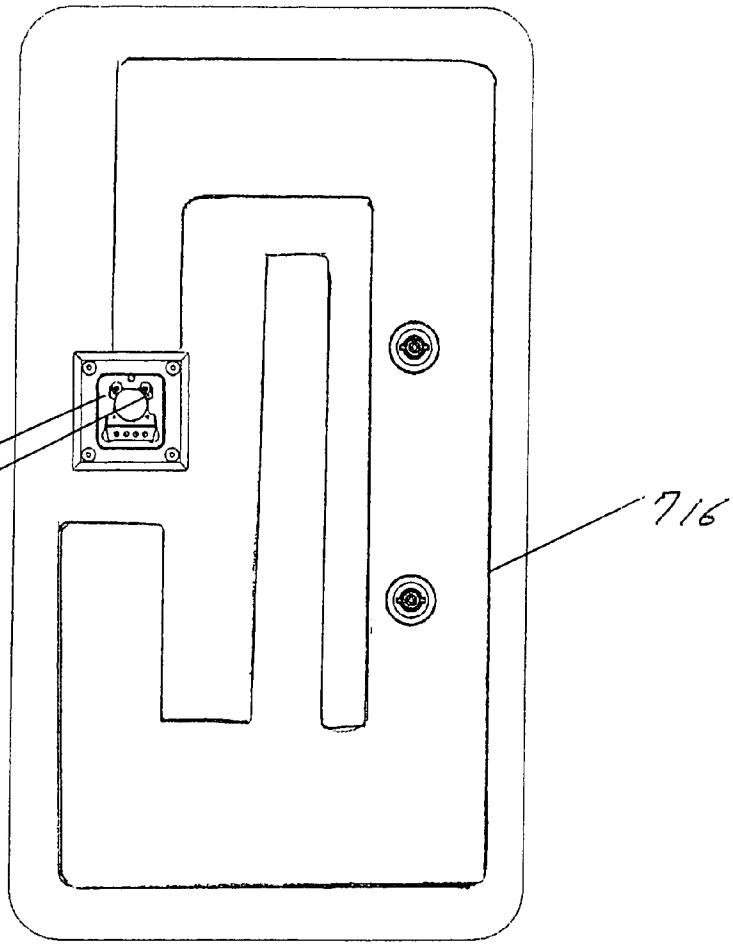

In a fourth embodiment, the Multifunctional Law Enforcement Tool of FIG. 1 is coupled together with the Standard Defense Shield of FIG. 13 of the second embodiment, wherein the Standard Defense Shield houses a Conductive Wire 716 of FIG. 14 and Defense Shield Contacts 334 and 335 of FIG. 14 to create an electrified, or "stun," shield to repel an attacker, once the Stun Gun Button 42 of FIG. 8 is activated by the user carrying current throughout the shield. The rest of the fourth embodiment remains unchanged from that of the second embodiment.

Figure 16:
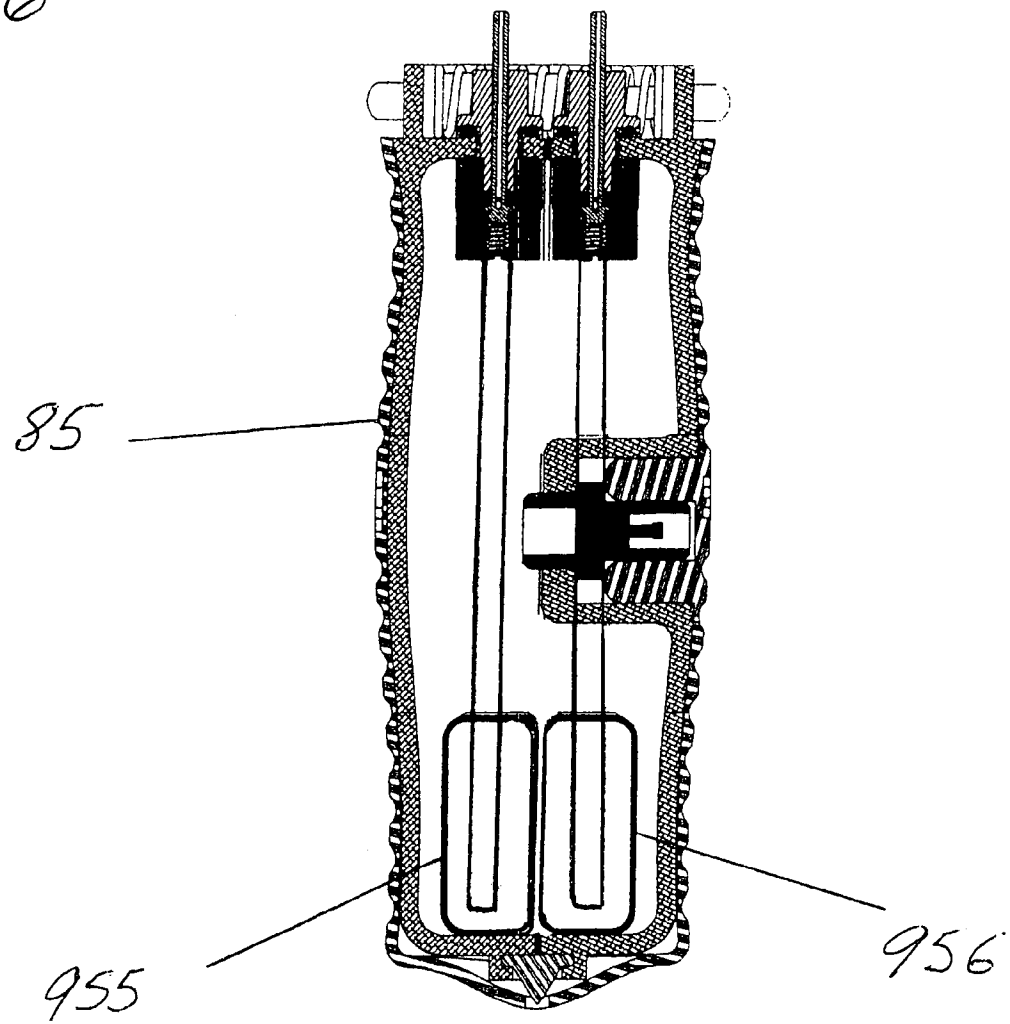
FIG. 16 depicts a cross-sectional view of the handle canister 85 of one embodiment of the Invention with dual bladders.

In a fifth embodiment, by simply changing the Handle Canister 84 of FIG. 1 to Handle Canister 85 of FIG. 16, the user gains a function called "Deterrent Spray Stun" or D.S.S. D.S.S. is a byproduct of the Stun Gun and Deterrent Spray features. The high voltage are between Stun Gun Probes/Battery Recharge Contact 8 and 21 of FIG. 2 is intercepted by the two conductive high pressure deterrent spray streams as they exit deterrent spray exit ports 22 and 9 of FIG. 2. This combination propels and exposed high voltage arc along the conductive streams to the target which completes the circuit and causes a neuromuscular disruption. This feature is able to take place in Handle Canister 85 of FIG. 16 because the Dual Bladders 955 and 956 of FIG. 16 house the deterrent spray separately from one another. The high voltage arc will first travel backwards into the can but will not be able to complete the circuit because Bladders 955 and 956 of FIG. 16 are separate and insulated from one another. The arc will then travel back out towards the target on the conductive streams of deterrent spray to the target, which will complete the circuit. This function can only be activated if Handle 85 of FIG. 16 is used. The user pushes the Stun/Spray Actuator/Battery Housing 75 of FIG. 17 in a forward manner. However, in Handle Canister 84 of FIG. 1 this reaction cannot take place because of Single Bladder 208 of FIG. 1 which allows the circuit to be completed, inside the single bladder disabling any potential D.S.S. feature to exist. The rest of the Multi-Functional Law Enforcement Tool of FIG. 1 remains unchanged.

Figure 18:
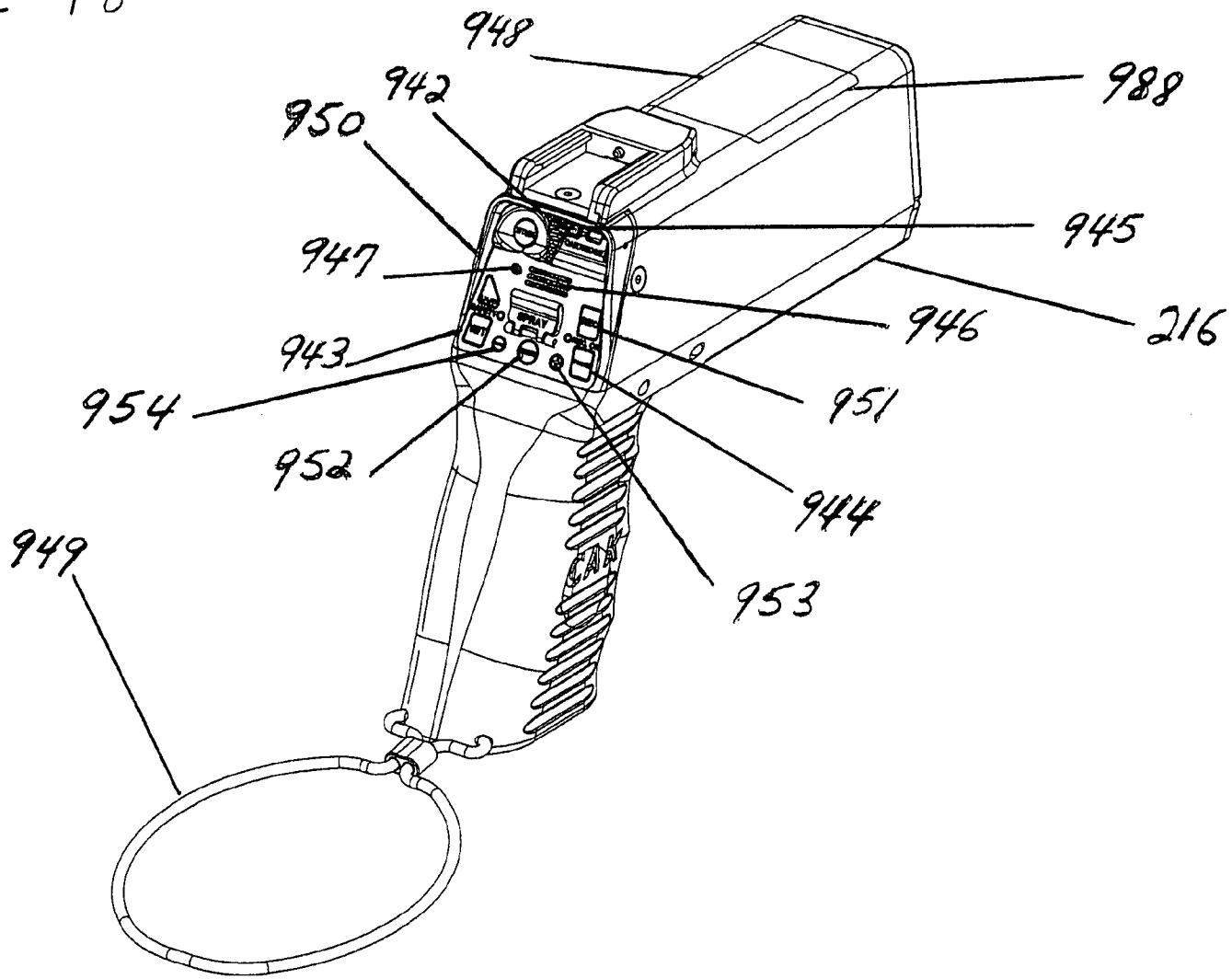
FIG. 18 depicts a rear, perspective view of the walkie talkie, telephone, global positioning system, video display screen and safety strap incorporated into the embodiment of the Invention depicted in FIG. 1.

In a sixth embodiment of the Multi-Functional Law Enforcement Tool, FIG. 18 depicts a unit wherein the Liquid Crystal Display 620 of FIG. 8 on the Switch Panel 108 of FIG. 8 is eliminated. Video Display Screen 948 of FIG. 18 allows the user to view text and video footage that is currently being recorded or from past recordings. The sixth embodiment also employs a Safety Strap 949 of FIG. 18 which simply allows the user the ability to let go of the Multi-Functional Law Tool without dropping it to the ground. The Safety Strap 949 of FIG. 18 also eliminates any potential take away scenarios by a suspect. The sixth embodiment Switch Panel TX-950 of FIG. 18 has Walkie Talkie Button 943, Walkie Talkie Speaker 946, Walkie Talkie Microphone 947, Telephone Button 944, Telephone Speaker 942, Telephone Microphone 945, Record Button 951. The walkie talkie feature of FIG. 18 gives the user the ability to have two way communication with a dispatcher or with headquarters. It has the ability to communicate by simply pushing Walkie Talkie Button 943 of FIG. 18 and speaking into Walkie Talkie Microphone 947 of FIG. 18. The user need only listen to Walkie Talkie Speaker 946 to hear what the dispatcher or other user is saying. This allows two way communication between the user and another person. The telephone feature of FIG. 18 is used by simply pushing Telephone Button 944 down, this activates voice recognition feature which allows the user to verbally recite the telephone numbers through Telephone Microphone 945 of FIG. 18. Then the call is automatically placed, the user needs only listen to Telephone Speaker 942 of FIG. 18 to directly communicate. The user may also activate stored phone numbers by pushing Menu Button XT-952 of FIG. 18. By viewing the list of phone numbers on Video Display Screen 948 of FIG. 18 and then by pushing the "+" Button 953 or "–" Button 954 of FIG. 18, the user can go up or down until he gets the number needed. The user then pushes the Telephone Button 944 of FIG. 18 and the call will be placed. Switch Panel TX-950 of FIG. 18 also has Record Button 951 of FIG. 18 which allow the user to record audible conversation between the user and a subject in a face to face setting. The user need only push the record button down once and the conversation will be picked up through Microphone 198 of FIG. 2. If the user wishes to record audio and video, the user must push the Record Button 951 a second time activating both Microphone 198 and Video Camera 199 of FIG. 2. The user need only look at the Video Display Screen 948 of FIG. 18 to make sure he is capturing the event. Video Display Screen 948 of FIG. 18 is also used to display Global Positioning System 988 of FIG. 18. Global Positioning System 988 can help officers or other users in a rural setting where addresses are unavailable, by giving the user features such as but not limited to longitude, latitude and heading. This will give the user the ability to know his position at all times. The Multi-Functional Law Enforcement Tools Global Positioning System 988 of FIG. 18 is a receiver which uses a satellite grid to track the Multi-Functional Law Enforcement Tool position and pin point its location. The rest of the Multi-Functional Law Enforcement Tool of FIG. 1 remains unchanged.

So, the core of the present invention is a multifunctional law enforcement tool having an elongated member with a longitudinal axis with a distal end and a proximal end, said elongated member having a flashlight and a deterrent spray dispenser near the distal end; a detachable handle adapted to be connected generally orthogonally to the elongated member near its proximal end, said handle housing a deterrent spray reservoir which is operably connected to said deterrent spray dispenser located near the distal end of said elongated member and a cartridge housing connected to said elongated member generally parallel to its longitudinal axis, the cartridge housing being an open bay, being adapted to receive removable cartridges, and having an electrical connection with the elongated member. The cartridge housing may house any or several components, providing increased capability for the multifunctional tool. For example, the housing may house a projectile cartridge, like, for example, bean bags, rubber balls, O.C. powder, neuromuscular disruption rounds, etc. Inserted cartridges may also fire tactical rounds such as colored smoke, breach rounds and concussion rounds.

The multifunctional tool may also house a global positioning system, and/or a communications system, for example, radio, walkie talkie, TV, audio microphone, video camera, video display screen, cell phone, and other communications. These optional equipments may alternatively be placed at other locations on the present multifunctional tool.

Other optional equipment which may be added to the present multifunctional tool include a standard defense shield, or a ballistic defense shield, or an electrified "stun" shield. Other, optional equipment which may be added to the present multifunctional tool include LED light, stun gun, stun projectile, glass breaker, I.D. card holder, pistol mount, laser sight, safety strap lanyard, etc.

Although this invention has been described above with reference to particular means, materials and embodiments, it is to be understood that the invention is not limited to these disclosed particulars, but extends instead to all equivalents within the scope of the following claims.

The invention claimed is:

1. A multifunctional law enforcement tool, comprising:

an elongated member with a longitudinal axis with a distal end and a proximal end, said elongated member having a flashlight and a deterrent spray dispenser near the distal end;

a detachable handle adapted to be connected generally orthogonally to the elongated member near its proximal end, said handle housing a deterrent spray reservoir which is operably connected to said deterrent spray dispenser located near the distal end of said elongated member; and a cartridge housing connected to said elongated member generally parallel to its longitudinal axis, said cartridge housing being an open bay, being adapted to receive removable cartridges, and having an electrical connection with said elongated member.

2. The tool of claim 1 wherein said cartridge housing houses a projectile cartridge with an explosive charge.

3. The tool of claim 1 wherein a shield is attached.

4. The tool of claim 3 wherein the shield is a standard defense shield.

5. The tool of claim 3 wherein the shield is a ballistic defense shield.

6. The tool of claim 3 wherein the shield is an electrified "stun" shield.

7. The tool of claim 1 which also comprises an LED for the flashlight.

8. The tool of claim 1 which also comprises a stun gun.

9. The tool of claim 1 which also comprises a stun projectile.

10. The tool of claim 1 which also comprises a glass breaker.

11. The tool of claim 1 which also comprises an ID cardholder.

12. The tool of claim 1 which also comprises a pistol mount.

13. The tool of claim 1 which also comprises a laser sight.

14. The tool of claim 1 which also comprises an audio microphone and recorder.

15. The tool of claim 1 which also comprises a video camera and recorder.

16. The tool of claim 1 which also comprises a deterrent spray stun mechanism.

17. The tool of claim 1 which also comprises a walkie talkie.

18. The tool of claim 1 which also comprises a telephone.

19. The tool of claim 1 which also comprises a safety strap.

20. The tool of claim 1 which also comprises a video display screen.

21. The tool of claim 1 which also comprises a global positioning system (GPS).

* * * * *